United States Patent [19]

Molnar

[11] Patent Number: 4,516,868

[45] Date of Patent: May 14, 1985

[54] MASTIC APPLICATOR AND ADJUSTABLE BLADE ASSEMBLY

[75] Inventor: Rick K. Molnar, Long Beach, Calif.

[73] Assignee: Hawk Industries, Inc., Signal Hill, Calif.

[21] Appl. No.: 383,094

[22] Filed: May 28, 1982

[51] Int. Cl.[3] ..... B28B 3/00; B29C 3/04

[52] U.S. Cl. ..... 401/5; 401/48; 401/171; 425/87; 74/567

[58] Field of Search ..... 401/5, 171, 48; 425/87; 15/235.8; 74/567

[56] References Cited

U.S. PATENT DOCUMENTS

| | | | |
|---|---|---|---|
| 2,300,398 | 11/1942 | Ames . | |
| 2,301,498 | 11/1942 | Ames . | |
| 2,413,684 | 1/1947 | Ames . | |
| 2,436,783 | 3/1948 | Ames . | |
| 2,571,096 | 10/1951 | Ames . | |
| 2,594,606 | 4/1952 | Ames . | |
| 2,666,323 | 1/1954 | Ames . | |
| 2,711,098 | 6/1955 | Ames . | |
| 2,809,513 | 10/1957 | Ames . | |
| 2,824,442 | 2/1958 | Ames . | |
| 2,824,443 | 2/1958 | Ames . | |
| 2,889,699 | 6/1959 | Ames . | |
| 2,889,965 | 6/1959 | Ames . | |
| 2,891,784 | 6/1959 | Taylor | 74/567 X |
| 2,984,857 | 5/1961 | Ames . | |
| 3,103,033 | 9/1963 | Ames . | |
| 3,116,511 | 1/1964 | Hoveland | 401/171 |
| 3,186,056 | 6/1965 | Hoveland | 401/48 |
| 3,343,202 | 9/1967 | Szujuna . | |
| 3,373,458 | 3/1968 | Haivala | 15/235.8 X |
| 3,451,757 | 6/1969 | Stroud et al. | 401/171 X |
| 3,602,405 | 5/1969 | Ames . | |
| 3,888,611 | 6/1975 | Ames . | |
| 4,129,407 | 12/1978 | Golls . | |

*Primary Examiner*—Steven A. Bratlie

*Attorney, Agent, or Firm*—Gausewitz, Carr, Rothenberg & Edwards

[57] ABSTRACT

A mastic applicator or "flat box" for use in application of mastic to tape drywall joints includes a container for storing and dispensing mastic. The container has a pressure plate which both supports the apparatus from a handle and applies pressure to force the mastic from an opening that extends across the direction of motion of the tool. To distribute and contour the mastic a flexible blade assembly extends along the rearmost edge of the opening and is positively driven through a range of infinitely adjustable positions by a means of a lever and camming linkage arrangement. The entire adjustment mechanism is itself adjustably mounted so as to selectively adjust the entire adjustment range.

6 Claims, 7 Drawing Figures

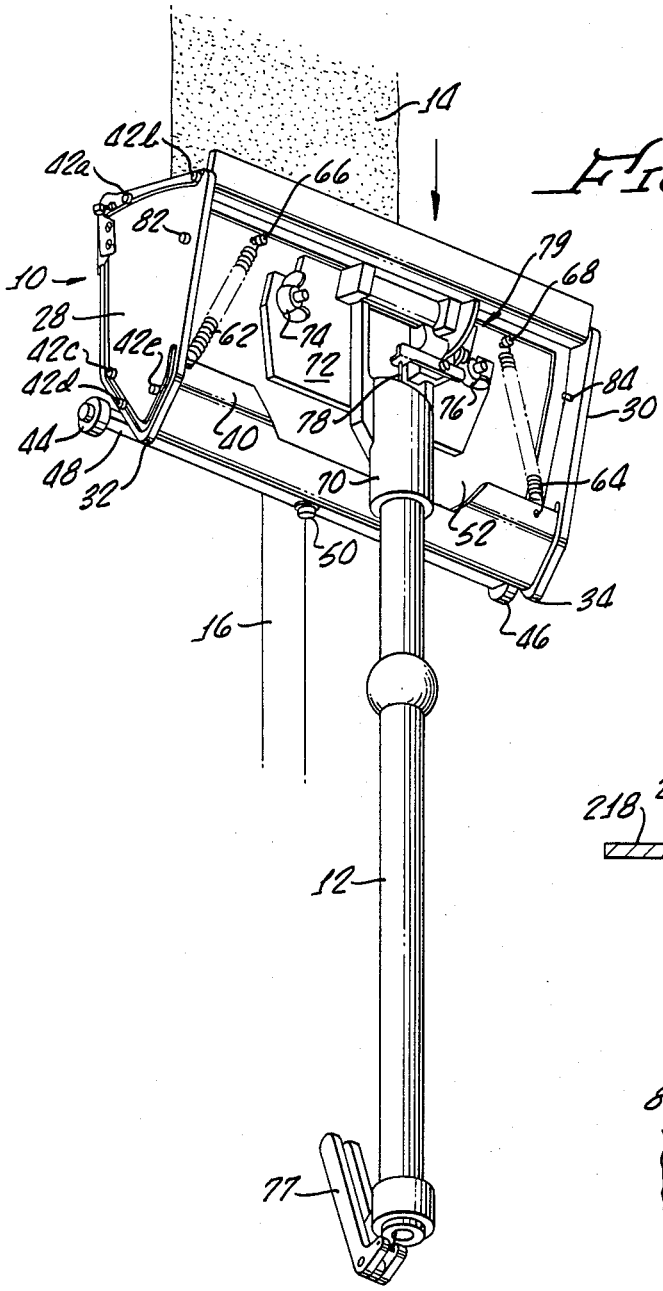
FIG. 1.
FIG. 7.
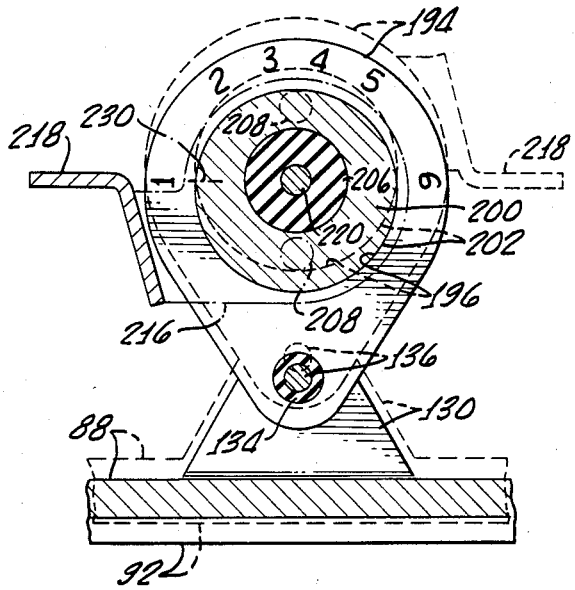
FIG. 2.
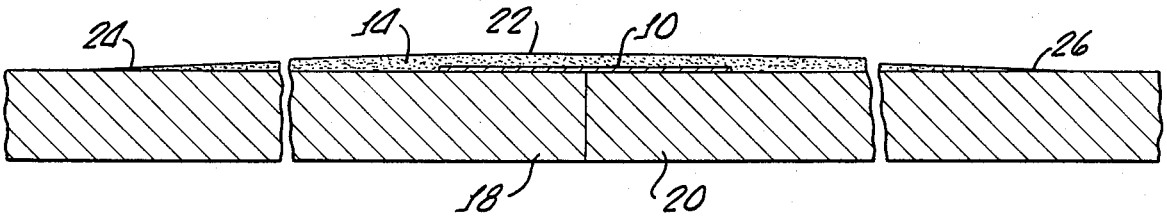

MASTIC APPLICATOR AND ADJUSTABLE BLADE ASSEMBLY

BACKGROUND OF THE INVENTION

This invention relates to apparatus for application and contouring mastic and more particularly concerns an improved adjustable blade assembly.

In the construction of drywall partitions in various types of buildings, the joint between adjacent panels of wallboard is covered by a strip of tape and a layer of mastic is applied over the tape to provide smooth surface continuity across the edges. The layer of mastic is of a slightly crowned configuration, being somewhat thicker at the center of the tape, and tapering toward feather edges where it blends with the surface of the adjacent drywall panel. The mastic commonly is applied to a taped drywall joint by running a mastic applicator vertically downwardly along the vertical joint and over the tape. Often, a first layer of mastic is applied in a lesser width, such as a width provided by a seven inch applicator and then a second layer is provided using a wider applicator tool.

The mastic applicator tool is supported by a handle which not only carries the weight of the tool and its mastic content but which also presses the mastic from the tool so that the dispensed mastic may be smoothed and contoured by a blade carried at the tool trailing edge. Thus, pressure exerted upon the handle tends to force mastic from the tool and also presses the tool and thus its contouring blade toward the wall to control thickness of applied mastic.

Mastic applying tools of this type are shown in a number of United States patents including the following: U.S. Pat. Nos. 2,571,096, 2,666,323, 2,711,098, 2,824,442, 2,889,699, 2,984,857, and 3,343,202. In these patents the contouring blade is fixedly mounted and adjusted by various means which enable the blade to assume one of a number of cured configurations as may be desired by the operator. Such contouring blades are difficult to adjust. It is often necessary, in order to obtain the proper shape of the resulting contoured mastic, for the operator to both apply an excessively great pressure on the handle and at the same time to move the tool at an undesirably rapid rate. Further, these tools have only a limited number of adjustments and generally attain adjustment by means of exerting pressure upon a flat spring which in turn resiliently presses against members affixed to portions of the blade. These arrangements employ a spring to perform an adjustment of only a single direction, that is, the adjustment can only cause the concavely curved blade to approach a straight condition or an outwardly bowed position. To increas the blade curvature, manual pressure is exerted on the blade as by passing the edge of the blade back and forth across the edge of a door jamb, for example. Thus, the blades are difficult to adjust, can be readily adjusted by the adjusting mechanism only in a single direction and, due at least in part to variable and changing spring characteristics, precision blade adjustment is not available. Prior art blade assemblies, furthermore, have a limited number of adjustment positions and the adjustment mechanism cannot be employed to dislodge or loosen solidifed mastic that may inadvertently remain on the tool after use.

Accordingly, it is an object of the present invention to provide a mastic applying and contouring tool that eliminates or minimizes above-mentioned problems.

SUMMARY OF THE INVENTION

In carrying out principles of the present invention in accordance with a preferred embodiment thereof, a mastic applicator and contouring tool comprises a container having an opening for dispensing mastic therefrom, means for causing mastic to flow from the container through the opening, and a flexible blade assembly for distributing and contouring mastic dispensed from the container. Improved adjustment of blade curvature is attained by adjusting means interconnected between the container and the blade and provided with an adjustable effective length. According to a feature of the invention, the adjusting means is formed of linkage members to provide a substantially rigid interconnection between container and blade with the linkage members relatively shiftable to change the effective length thereof. In a presently preferred arrangement, the linkage members comprise an interconnected cam and cam follower connected to and between the container and blade. Frictional restraint on the cam is provided to hold the assembly in adjusted position. A range of continuous adjustment is provided and this range, in its entirety, is adjusted by an arrangement for adjustably connecting the primary adjustment assembly to the container.

BRIEF DESCRIPTION OF THE DRAWINGS

FIG. 1 is a perspective view of a tool embodying features of the present invention, the tool being shown as it is moved downwardly along a vertically extending taped wall joint;

FIG. 2 illustrates a taped wall joint and a layer of mastic applied thereto by the tool of the present invention;

FIG. 7 is an enlarged view of the cam adjustment mechanism.

DETAILED DESCRIPTION

Figure 3:
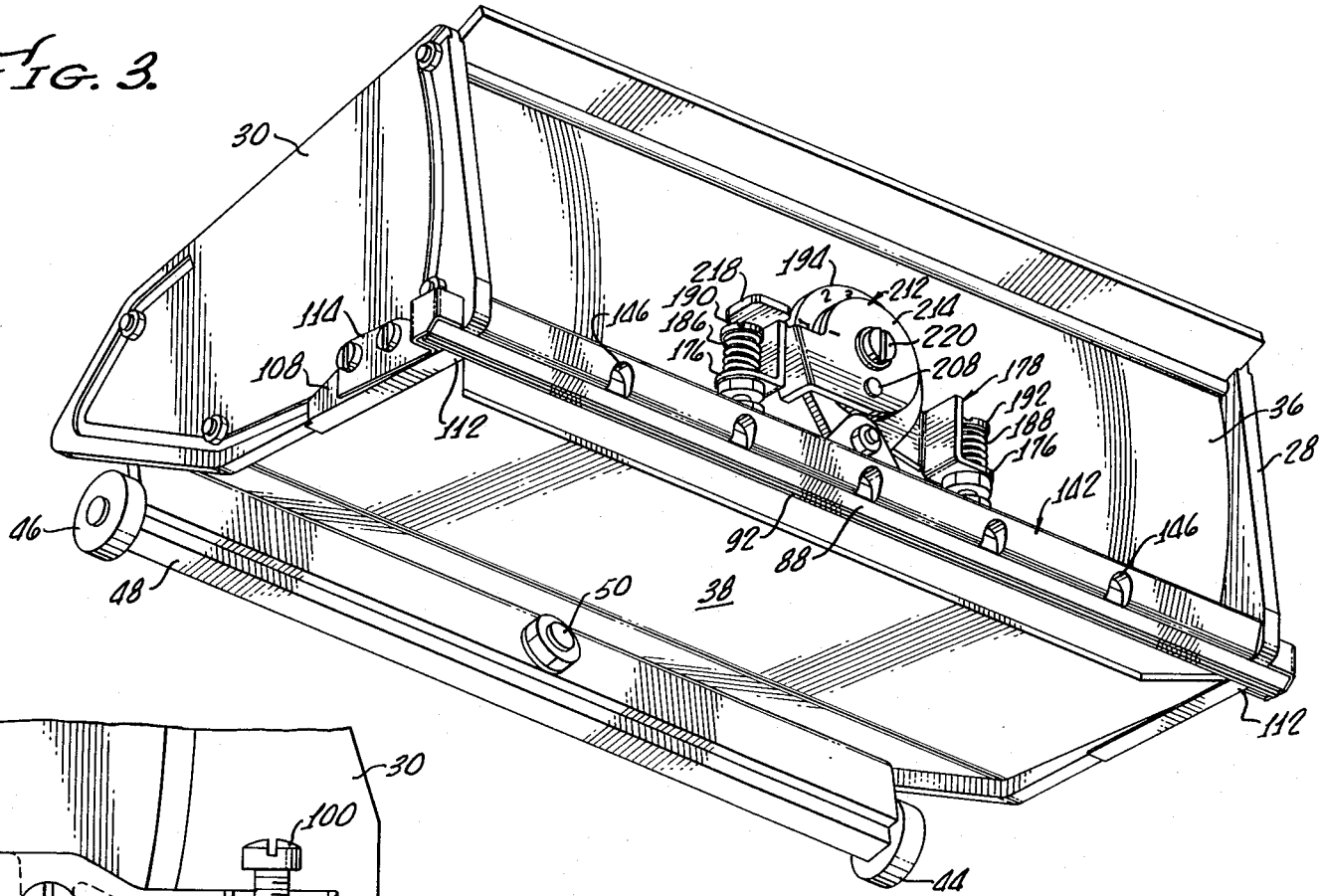
FIG. 3 is a perspective view of the rear outer end of the container of the tool of FIG. 1.

As illustrated in FIGS. 1 and 2, a tool generally comprising a container 10 supported by a handle 12 is employed to deposit and contour a layer of mastic 14 along and over a strip of tape 16 that covers a vertical joint between two installed vertical wall panels, 18, 20. FIG. 2 is a horizontal section showing the relation of joint, tape and mastic. It will be seen that the applied strip of mastic has a central portion 22 that is raised, or crowned, and that this central portion tapers to either side, to feather edges 24, 26, where it smoothly and almost invisibly blends with the surface of the respective panels. A smooth and evenly contoured surface of the mastic covering is desired. Thereafter, when covered with a suitable coating such as paint, wallpaper or the like, the joint is not noticeable. Depending upon the nature of the walls and the joint therebetween, and other factors observed by the operator applying the mastic, the mastic is to be applied in different thicknesses and with different curvatures. As the operator becomes more skilled, a greater variety of mastic curvatures may be employed and, therefore, a greater range and a finer adjustment are needed.

A tool embodying principles of the present invention provides a range of infinitely variable or continuous adjustments by securing the blade ends to the container and positively driving a central portion of the blade in two directions, driving the blade downwardly in order to decrease its concave curvature, (or to obtain an outwardly bowed configuration) and also positively driving the blade upwardly so as to increase its concave curvature. The adjustment mechanism provides an essentially rigid adjustable length interconnection between the blade and container and also provides a mechanism to hold the blade in its adjusted condition.

Tool container 10 is formed of a pair of rigid sidewalls 28, 30 having edges that converge at forward ends 32, 34. Extending between the sidewalls and seated in inwardly facing appropriately configured grooves formed on the interior surfaces of the side walls are a curved rear wall 36, an angulated outer (or bottom) wall 38 and an angulated wall 40 fixedly secured to the forward edge of the outer wall 38. The sidewalls and thus the rear wall, outer wall and forward wall are secured to one another by a plurality of laterally extending tension rods 42*a*, 42*b*, 42*c*, etc., which extend the full length of the apparatus through suitable apertures in the side walls and have nuts affixed to the threaded ends thereof beyond the side walls, thus tensioning each of the rods and firmly holding the container walls in assembled condition.

A pair of forward wheels 44, 46 is rotatably mounted on ends of a transversely extending forward support bar 48 which is pivotally connected to the container forward wall 40 by means of a pivot pin 50 extending along an axis perpendicular to the wheel axis. In use on a vertical wall joint the wheel axes are horizontal and the pivot pin axis is substantially vertical.

A pressure plate 52 extends completely across the entire area of the container from side to side and from front to back, having a forward pivot edge captured within and thus loosely and pivotally bearing upon the inner surface of the forward edge 54 of the angulated front wall 40. The pressure plate has a sealing gasket 56 secured to its rear and side edges to bear against the rear and side walls to seal the mastic containing chamber 60 thereof. The center of curvature of the rear wall, as viewed in FIG. 5 coincides with the pivot edge of the pressure plate so that the rear edge of the plate remains in contact with the rear wall throughout its pivotal motion.

Figure 5:
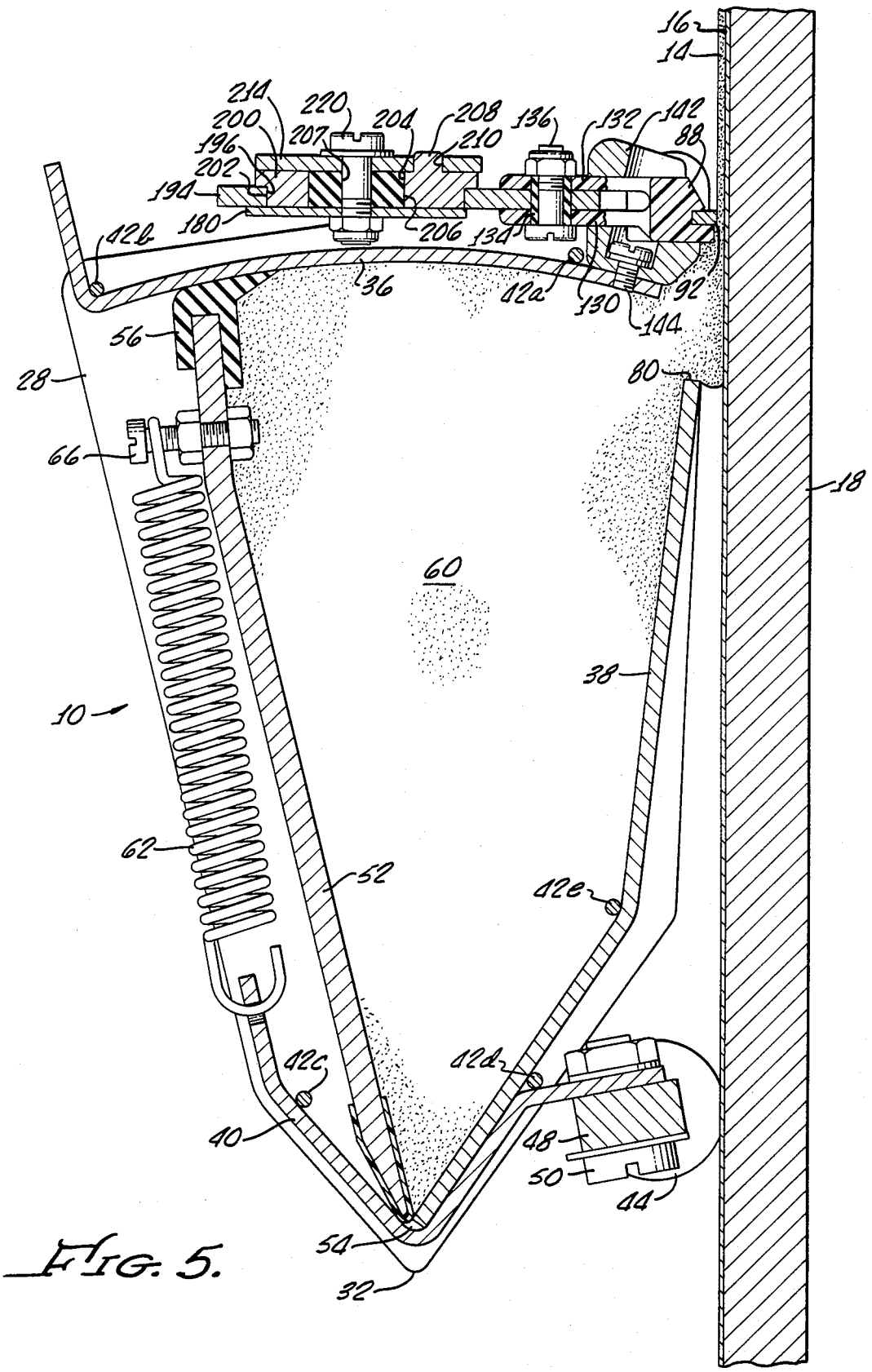
FIG. 5 is a section of the tool of of FIGS. 1 and 3.

Pressure plate 52 is urged about its forward fulcrum in a counterclockwise direction as viewed in FIG. 5 by means of a pair of springs 62, 64 connected between rearwardly projecting edges of forward wall 40 and studs 66, 68 fixed to the outer surface of the pressure plate near the sides thereof.

Handle 12 is fixed to a sleeve 70 which in turn is pivoted to a handle support bracket 72 that is detachably fixed to the pressure plate 52 by means of bolts and wing nuts 74, 76. A latch operator 77 on the end of the handle is connected by means of a cable 78 to a latch 79 that selectively locks the handle sleeve 70 to bracket 72 to prevent relative pivotal motion thereof.

Bottom wall 38 extends toward, but is forwardly spaced from, the outer or bottom edge of the curved rear wall 36 to define therebetween a container opening 80 from which mastic is dispensed from the chamber 60.

The entire apparatus is supported by means of the handle which is connected to the pressure plate. The pressure plate is only movably connected with and confined within the container walls, its outer pivotal motion being limited by removable stop pins 82, 84. However, the plate is a close sliding fit within the container. With the chamber 60 containing a suitable supply of mastic, the entire apparatus, including the mastic contained therein, is readily supported by the handle, via the pressure plate and its engagement to and within the container side walls. The entire pressure plate is readily removed upon withdrawal of the stop pins.

The apparatus may be pressed against the taped wall joint by exerting pressure upon the handle 12. The latter, in turn, applies pressure to the rearward end of the pressure plate at which end the bracket 72 is secured to the plate. Pressure applied to the plate is transferred to the confined body of mastic which can flow from the container only through the restricted opening 80. The mastic therefore, in turn, applies pressure to the bottom of the container to press the latter against the wall panels 18, 20 as the tool is moved downwardly.

Figure 4:
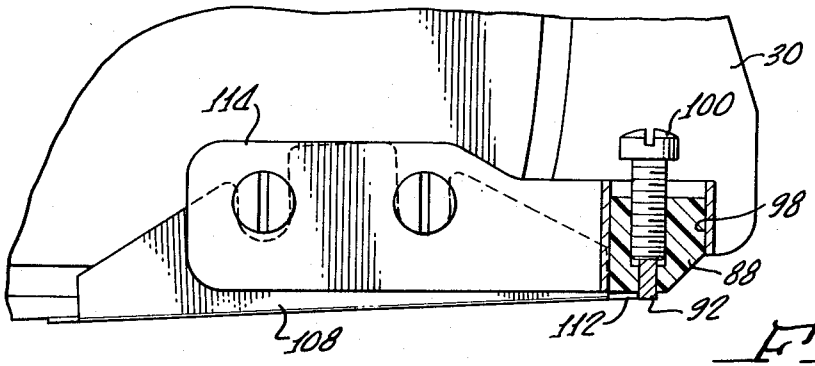
FIG. 4 is a fragmentary side view of the one corner of the rear of the tool of FIG. 1.

A flexible and adjustable curvature mastic distribution and contouring blade assembly, together with a mechanism for controlling curvature thereof, are carried by the container rear wall 36 adjacent the container opening 80. The blade assembly comprises a molded plastic blade carrier 88 having a generally rectangular cross section and having an outwardly facing longitudinal groove formed therein to provide tight and snug reception of a wear resistant, contouring and mastic applying blade 92, which is preferably made of a flexible stainless steel. Each end of the carrier 88 is slidably received and captured within outwardly facing grooves 98 at the rear ends of the edges of the respective side walls 28, 30. Blade 92 is adjusted relative to the carrier by means of a pair of screws 100 threaded into the carrier at each end thereof and bearing upon an inner end of the blade (FIG. 4). Thus, as the blade wears it may be moved further outwardly of the carrier to insure projection of the blade beyond the carrier edges. The outer surface of the carrier is chamfered to enhance the outward flow and distribution of the mastic.

To retain the blade assembly within the side wall grooves 98 each side wall carries a metal shoe 108 having an inwardly directed bottom flange with a rearward projecting end portion 112. The wear shoe is bolted to the end walls and held in place by a plate 114, so that the rearward flange 112 is directly beneath the outer edge of the carrier 88 to retain the carrier within the side wall slots 98 and to further secure and position the carrier with respect to the side walls.

The central portion of carrier 88 is formed with a pair of mutually spaced upstanding drive lugs 130, 132 of generally triangular configuration having mutually aligned apertures in their narrower upper ends which receive a bushing 134 in which is mounted a pivot shaft 136 which may take the form of a nut and bolt.

Figure 6:
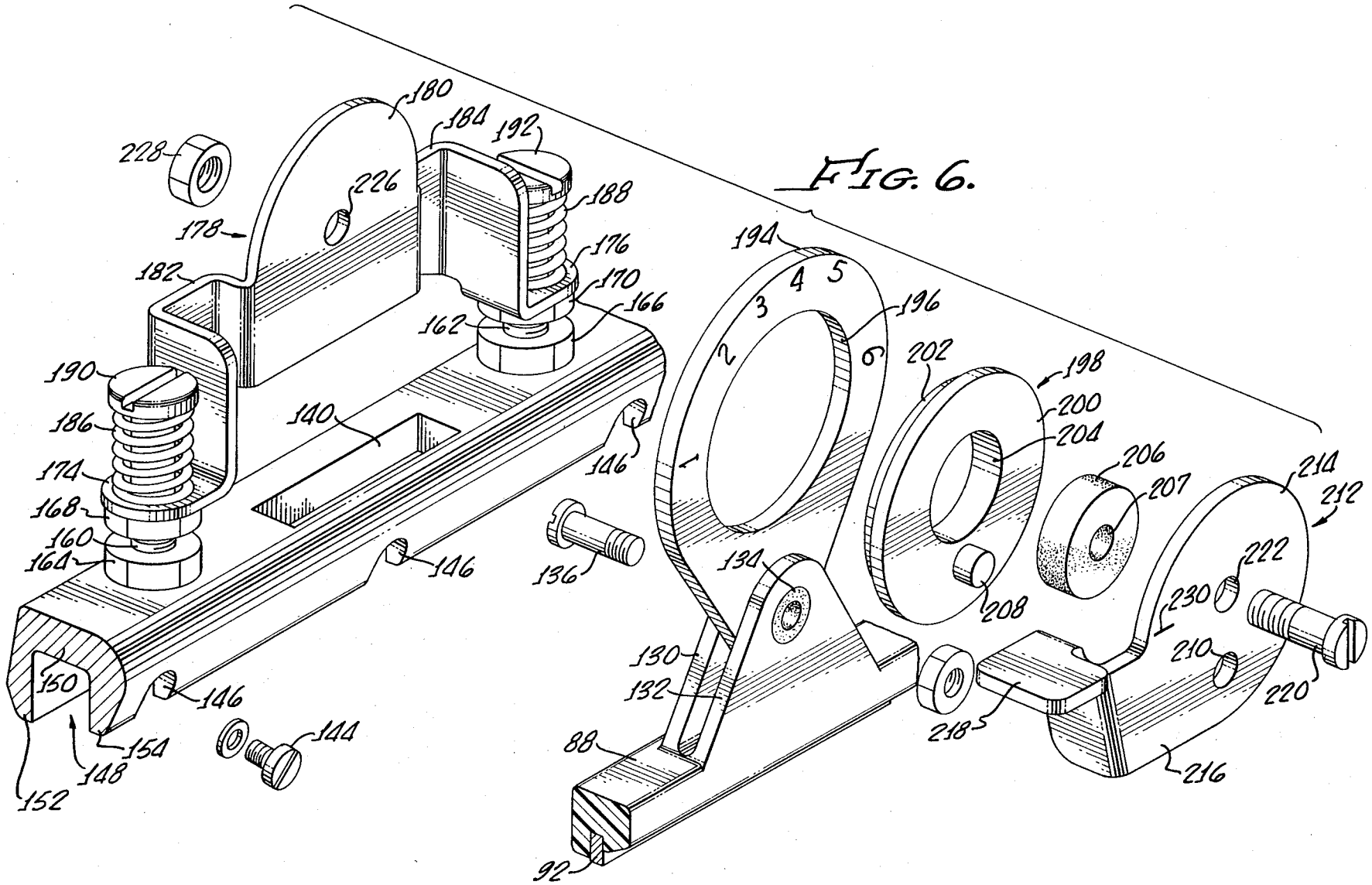
FIG. 6 is an exploded perspective view of portions of the adjustment mechanism of the tool of FIGS. 1 and 3.

Both of drive lugs 130 and 132 extend upwardly through an elongated rectangular aperture 140 in a rigid mounting and stiffening channel 142 (see FIGS. 5 and 6). Channel 142 is formed of an extruded aluminum or other suitable rigid material and is fixedly connected to the rear wall 36 by means of a plurality of screws 144 which are accessible through slots 146 formed in the front wall of channel 142. The channel has a downwardly facing recess 148 in which is received the blade carrier 88 with its lugs 130, 132 projecting upwardly through aperture 140. The upper surface of carrier 88 is spaced below the web 150 of the channel (see FIGS. 4 and 5) in order to provide for blade curvature adjustment, as will be described below. Side legs 152, 154 of the channel member are a snug but slidable fit along the front and back sides of the carrier 88. This provides for stiffening and lateral support of the carrier and blade which, therefore, can bend only in the plane of the blade.

A pair of bolts 160, 162 are threaded into the web of the channel member 142, on opposite sides of and adjacent the centrally located aperture 140. The bolts are fixed in position by means of nuts 164, 166 threaded on the bolts and bearing against the upper surface of the channel member. Lock nuts 168, 170 are also threaded on the bolts which pass through outwardly extending ears 174, 176 formed on a mounting bracket 178. Bracket 178 includes a flat back plate 180 and laterally outwardly extending side legs 182, 184 at the lower ends of which are formed the bracket mounting ears 174, 176. Springs 186, 188 are compressed between the mounting ears 174, 176 and the enlarged heads 190, 192 of the bolts. Thus, the entire mounting bracket itself may be readily adjusted vertically (as viewed in FIGS. 3 and 6), moved toward or away from the stiffening channel 142, merely by loosening the holding nuts 164, 166 and turning the bolts 160, 162 to raiser or lower the entire bracket. Springs 186, 188 are relatively stiff and will not deflect significantly in response to forces applied during normal operation of the tool. The springs act solely as shock absorbers to allow deflection and absorption of energy in the presence of suddenly applied excessive forces as might occur if a loaded tool should accidentally fall to the floor.

Pivoted on the shaft 136 that extends through the blade carrier ears 130, 132 is a yoke plate 194 having a circular aperture 196. The yoke plate carries adjustment position indicia indicated by numerals 1–6 thereon. A cam 198 in the form of a circular disc 200 having a decreased diameter but thicker hub 202 is formed with a circular opening 204 that is centered at a point positioned slightly above the center of the circular periphery of hub 202 and also slightly above the center of circular opening 196 of the yoke plate. Hub 202 is received as a snug but sliding fit within the aperture 196 of the yoke plate. The yoke plate aperture 196 forms a cam following surface that engages the cam to drive the yoke plate toward or away from the blade carrier. A deformable cylindrical bushing 206 having an axial aperture 207 is positioned within the opening 204 of the cam. A drive pin 208 is fixed to the surface of cam disc 200 and extends axially rearwardly into an aperture 210 in a lever 212. Lever 212 is formed with an enlarged circular body portiion 214 having a radially outwardly extending arm 216 that termintes in a flat finger tab 218 which may be readily grasped by an operator for adjustment of the tool. A pivot shaft in the form of a headed bolt 220 extends through a central aperture 222 of the lever body section, through the hole 207 of the bushing and through a hole 226 of the central portion 180 of the mounting bracket 178. A nut 228 is threaded on the end of the pivot bolt 220. Shaft 220 is coaxial with cam opening 204 and, therefore is slightly above the center of hub 202 and slightly above the center of yoke opening 196.

The unstressed axial length of bushing 206 is greater than the distance between the facing inner surfaces of the mounting bracket 178 and lever 212 when the parts are assembled. Accordingly, upon assembly, the bushing is axially compressed, and since it is circumferentially restrained, the compression forces the bushing inwardly against the pivot shaft 220 and outwardly against the inner surface of circular hole 204 of the cam member.

Lever 212 is formed with an index marker 230 that is lined up with the numeral 1 of the yoke plate when the lever 212 is in its limiting counterclockwise position as illustrated in solid lines in FIG. 7. In this position the blade has its minimum curvature or, if deemed necessary or desirable, it may be even bowed downwardly, (outwardly convex). As the lever 218 is moved from its extreme limiting position (shown in solid lines in FIG. 7) wherein it rests upon the top of the leg 182 of mounting bracket 178, cam 198 rotates about the axis of pivot shaft 220, being driven by the interengagement of drive pin 208 and aperture 210 of the lever. Because the periphery of the cam is eccentric to the cam pivot axis the yoke plate is shifted and this motion of the yoke plate has a component of vertical motion which pulls the blade carrier ears 130, 132 upwardly (as viewed in FIG. 7), thus pulling the central portion of the blade carrier upwardly and increasing the concave curvature of the blade of which the ends are captured in the side walls of the container. As the lever is rotated counterclockwise (as viewed in FIG. 7) the center of the blade carrier is driven downwardly to decrease blade curvature. This the arrangement provides a positive bidirectional drive of the blade carrier, enabling the blade to be positively driven to and retained in any one of an unlimited number of positions. The lever is provided with a freedom of one hundred-eighty degrees of motion between limiting positions (shown in solid and dotted lines in FIG. 7) wherein it abuts the upper surface of legs 182, 184 of the mounting bracket. In a presently preferred configuration, the center of the hole in the yoke is offset below the center of the pivot shaft by 0.050 inches, thus providing a total range of adjustment of 0.100 inches.

In order to adjust this range of adjustments in its entirety, that is, to shift the limiting positions of the range, the mounting bracket itself is adjustable. As previously described, this is achieved by moving the mounting screws 160, 162 so as to raise or lower the mounting bracket. This secondary adjustment of the entire range of adjustments afforded by the cam and yoke plate arrangement significantly facilitates manufacuring and assembly and, in particular, greatly relaxes manufacturing tolerances that would be otherwise required for attainment of precision adjustment and precision location of the range of adjustment. Thus, each individual tool may be adjusted individually by the operator to choose his own particular preferences with regard to the range of adjustments that he would prefer to employ. Further, the adjustment of the mounting bracket itself in effect significantly extends the range of adjustments available with this tool. Accordingly, one may employ the described cam and yoke arrangement for making exceedingly fine adjustments in infinitely small steps by means of the lever which moves through a relatively long distance. In effect, this achieves an amplification of the small actual adjustment for presentation to the operator as a larger lever motion and concomitantly larger indicating scale of adjustment. Stated otherwise, a relatively large motion of the lever produces a relatively small amount of adjustment, and thus, a fine precision adjustment is more readily achieved. However, with such fine adjustment only a limited range of adjustment would be available because of the larger lever motion that is provided. This problem is alleviated by making the mounting bracket itself adjustable so as to provide adjustment of the entire range.

As previously mentioned, the bushing 206 is axially compressed upon assembly and thus is forced both outwardly against the surface of hole 204 of the cam plate and inwardly against the surface of the pivot shaft 220. Accordingly, the bushing frictionally presses against the surface of shaft 220 and may rotate around the the pivot shaft when the lever is pivoted to drive the cam which frictionally grasps the outer periphery of the bushing. However, the frictional forces exerted by the bushing are sufficient to prevent inadvertent displacement of the lever and, thus, of the blade and its carrier from adjusted position.

The cam and yoke plate act as a form of linkage of effectively adjustable length, rigidly interconnecting the carrier with the container, the yoke plate providing a first linkage member and the eccentric cam providing the second linkage member of an exceedingly short, or small, effective length (an effective length equal to the 0.050 inch eccentricity).

It will be seen that the described adjustment mechanism provides a positive adjustment that fixedly and rigidly positions the center of the blade and carrier with respect to the container. Thus, because the outer ends of the blade carrier are fixed, the blade and carrier then will assume a smooth continuous curvature determined by the adjusted and fixedly maintained position of its center. Not only can the adjustment mechanism drive the central portion of the blade downwardly to decrease its concave curvature, but it can also drive it upwardly to increase its concave curvature. This bidirectional positive drive has an unexpected advantage in dislodging or loosening mastic that inadvertently may have been left to harden on or about the blade. In prior tools, where such mastic hardens on the blade, the tool must be disassembled to remove the hardened mastic. In the tool described herein, on the other hand, the positive bidirectional drive of the carrier and flexing of the blade achieved by rotating the operating lever back and forth, is sufficient to loosen and dislodge hardened mastic in many cases.

The adjustable mounting bracket, being adjustably mounted by means of the springs 186, 188, provides both shock resistance to the mechanism and shifting of the adjustment range. It may be noted, as previously mentioned, that these springs do not deflect significantly during the normal adjustment or operation of the tool so that the adjustment does, in truth, provide an effectively rigid interconnection and an adjustable interconnection between the blade carrier and the container.

The foregoing detailed description is to be clearly understood as given by way of illustration and example only, the spirit and scope of this invention being limited solely by the appended claims.

What is claimed is:

1. Apparatus for applying and dispensing mastic comprising a container for confining a quantity of mastic, said container including an opening for dispensing mastic from the container, and means for causing mastic to flow from said container through said opening, and an adjustable curvature blade assembly for distributing and contouring mastic dispensed from the container, said assembly comprising a blade carrier connected at end portions thereof to said container, a flexible blade secured to said carrier, and adjustment means interconnected between said container and an intermediate portion of said carrier for shifting the intermediate portion of the carrier relative to said end portions thereof to control curvature of the blade, said adjustment means comprising rigid linkage means connected to said container and connected to said carrier for effecting a positive bidirectional adjustment of said blade to increase or decrease curvature of the blade, and means for selectively changing the effective length of said linkage means, said rigid linkage means restraining motion of an intermediate portion of said blade in both directions from adjusted position to thereby hold the blade in its adjusted position, said adjustment means comprising first and second interconnected linkage members connected respectively to said blade carrier and said container, said first linkage member comprising a yoke plate pivotally connected to said blade carrier, and said second linkage member comprising a cam interengaged with said yoke plate and having a pivotal connection to said container on a pivot axis substantially fixed to said container, and including means for adjustably pivoting said cam to thereby cause said cam to positively drive said yoke plate and blade in either of two opposite directions, said yoke plate comprising a plate having a circular aperture and said cam comprising a disc mounted to said container for pivotal motion about a pivot axis, said disc having a circular periphery received within the circular aperture of said yoke plate, said circular periphery being centered upon an axis offset from said pivot axis.

2. Apparatus for applying and dispensing mastic comprising a container for confining a quantity of mastic, said container including an opening for dispensing mastic from the container, and means for causing mastic to flow from said container through said opening, and an adjustable curvature blade assembly for distributing and contouring mastic dispensed from the container, said assembly comprising a blade carrier connected at end portions thereof to said container, a flexible blade secured to said carrier, and adjustment means interconnected between said container and an intermediate portion of said carrier for shifting the intermediate portion of the carrier relative to said end portions thereof to control curvature of the blade, said adjustment means comprising rigid linkage means connected to said container and connected to said carrier for effecting a positive bidirectional adjustment of said blade to increase or decrease curvature of the blade, and means for selectively changing the effective length of said linkage means, said rigid linkage means restraining motion of an intermediate portion of said blade in both directions from adjusted position to thereby hold the blade in its adjusted position, said adjustment means comprising first and second interconnected linkage members connected respectively to said blade carrier and said container, said first linkage member comprising a yoke plate pivotally connected to said blade carrier, and said second linkage member comprising a cam interengaged with said yoke plate and having a pivotal connection to said container on a pivot axis substantially fixed to said container, and including means for adjustably pivoting said cam to thereby cause said cam to positively drive said yoke plate and blade in either of two opposite directions, a mounting bracket, said adjustment means being connected to said mounting bracket, and means for adjustably connecting said mounting bracket to said container to effect adjustment of said adjustment means relative to said container whereby the entire range of adjustment available by adjustment of said adjustment means may be shifted by adjustment of said mounting bracket.

3. A tool for dispensing and contouring mastic comprising a container for confining a quantity of mastic, said container comprising a pair of mutually spaced side walls, a back wall and bottom wall fixed to and extending between said side walls, said back wall and bottom wall having outermost rear edges thereof mutually spaced from one another to define a mastic dispensing opening of said container, means for causing mastic to flow from said container through said opening, and an adjustable blade assembly for contouring mastic dispensed from said opening, said assembly comprising a blade carrier fixed at its ends to said side walls and carrying an outwardly projecting blade, a yoke plate pivoted to a central portion of said carrier and having a cam follower surface, a cam engaged with said cam follower surface of said yoke plate for exerting upward or downward force thereon, a pivot shaft extending through said cam, means for mounting said pivot shaft to said container on a substantially fixed pivot point, and means for rotating said cam about said pivot shaft to positively adjust said yoke plate and blade in one direction or the other whereby said blade is positively restrained by said cam and yoke plate against inadvertent displacement in either of said directions from its adjusted position, said means for mounting said pivot shaft comprising mounting bracket, said pivot shaft being connected to said bracket, and means for adjustably connecting said mounting bracket to said container, whereby said blade carrier, yoke plate, cam and pivot shaft may all be adjusted relative to said container to thereby adjust the range of adjustments available from said yoke plate and cam.

4. The tool of claim 3 including means for resiliently connecting said mounting bracket to said container.

5. The tool of claim 3 wherein said means for adjustably connecting said bracket comprises a channel member fixed to said container, a headed shaft being fixed to said channel member and extending through said bracket, an adjustable stop member on said headed shaft and spring means on said headed shaft for urging said bracket against said stop member.

6. A tool for dispensing and contouring mastic comprising a container for confining a quantity of mastic, said container comprising a pair of mutually spaced side walls, a back wall and bottom wall fixed to and extending between said side walls, said back wall and bottom wall having outermost rear edges thereof mutually spaced from one another to define a mastic dispensing opening of said container, means for causing mastic to flow from said container through said opening, and an adjustable blade assembly for contouring mastic dispensed from said opening, said assembly comprising a blade carrier fixed at its ends to said side walls and carrying an outwardly projecting blade, a yoke plate pivoted to a central portion of said carrier and having a cam follower surface, a cam engaged with said cam follower surface of said yoke plate for exerting upward or downward force thereon, a pivot shaft extending through said cam, means for mounting said pivot shaft to said container on a substantially fixed pivot point, means for rotating said cam about said pivot shaft to positively adjust said yoke plate and blade in one direction or the other whereby said blade is positively restrained by said cam and yoke plate against inadvertent displacement in either of said directions from its adjusted position, and a resilient bushing interposed between said cam and said pivot shaft to thereby exert a frictional restraint against pivotal motion of said cam about said shaft.

* * * * *